United States Patent [19]

Nakanishi

[11] 4,338,063

[45] Jul. 6, 1982

[54] DIFFUSER OF CENTRIFUGAL COMPRESSOR

[75] Inventor: Keiichi Nakanishi, Yokohama, Japan

[73] Assignee: Nissan Motor Company, Limited, Yokohama, Japan

[21] Appl. No.: 204,932

[22] Filed: Nov. 7, 1980

[30] Foreign Application Priority Data

Nov. 30, 1979 [JP] Japan ..... 54/154231

[51] Int. Cl.[3] ..... F01D 17/12

[52] U.S. Cl. ..... 415/164

[58] Field of Search ..... 415/163, 164, 207, 211, 415/165

[56] References Cited

U.S. PATENT DOCUMENTS

| | | | |
|---|---|---|---|
| 2,976,013 | 3/1961 | Hunter | 415/163 |
| 3,495,921 | 2/1970 | Swearingen | 415/163 |
| 4,242,042 | 12/1980 | Swearingen | 415/163 |

*Primary Examiner*—Louis J. Casaregola

[57] ABSTRACT

A centrifugal fluid compressor including a rotatable fluid impeller and a fluid diffuser positioned coaxially around the impeller and comprising a plurality of diffuser vanes each arranged in such a manner that the angular position of the vane with respect to the center axis of the impeller and the distance between the outer peripheral end of the impeller and the leading end of the vane are variable independently of each other.

2 Claims, 5 Drawing Figures

DIFFUSER OF CENTRIFUGAL COMPRESSOR

FIELD OF THE INVENTION

The present invention relates to a centrifugal fluid compressor of the type having a fluid diffuser with variable-angle diffuser vanes.

BACKGROUND OF THE INVENTION

A centrifugal compressor of the type above mentioned is used mainly in a gas turbine and is designed and engineered to satisfy two major requirements. One requirement is to reduce the fluid friction loss in the compressor so as to achieve a high compression efficiency. The other requirement is to preclude an occurrence of surging when the compressor is operated at low fluid flow rates. Provision of a fluid diffuser having variable-angle vanes is used for meeting these two requirements.

For the purpose of reducing the fluid friction loss in the compressor to a minimum, it has been proposed to design the compressor in such a manner as to reduce the distance between each of the variable-angle diffuser vanes and a fluid impeller around which the diffuser vanes are circumferentially arranged. Drawbacks are however encountered in a prior-art fluid compressor of this type in that the compressor tends to produce increased amounts of noise and in that shock waves are produced between the impeller and the diffuser vanes and cause deterioration in the output performance of the compressor. If, furthermore, the diffuser vanes are arranged to lie more closely to radial directions of the diffuser so as to reduce the distance between the impeller and the diffuser vanes, the compressor will cause surging at low fluid flow rates. If, on the contrary, the diffuser vanes are arranged to lie closer to the circumferential direction of the diffuser, the occurrence of surging will be precluded but, instead, an increase in the fluid friction loss in the compressor will result.

The present invention contemplates provision of an improved centrifugal fluid compressor eliminating these drawbacks which have thus far been encountered in a prior-art centrifugal fluid compressor having a fluid diffuser with variable-angle diffuser vanes.

SUMMARY OF THE INVENTION

In accordance with the present invention, there is provided a centrifugal fluid compressor including a fluid impeller rotatable about its center axis and a fluid diffuser comprising a plurality of variable-angle diffuser vanes which are positioned around the impeller, wherein the diffuser vanes are arranged so that the angular position of each of the diffuser vanes with respect to the center axis of the impeller and the distance between the outer peripheral end of the impeller and each of the diffuser vanes in radial direction of the diffuser are variable independently of each other.

Each of the diffuser vanes may be formed with a circular hole and an elongated slot which are spaced apart from each other longitudinally of the diffuser vane, the elongated slot extending in the longitudinal direction of the diffuser vane. In this instance, the diffuser in the centrifugal fluid compressor according to the present invention further comprises two stationary support plates which are spaced apart from each other in an axial direction of the diffuser and which have the diffuser vanes movably interposed therebetween, and two eccentric pins provided in association with each of the diffuser vanes, the pins being supported on one of the support plates respectively through openings formed therein and being rotatable independently of each other about axes off set from their respective center axes and substantially parallel with the center axis of the impeller, the eccentric pins axially projecting into and being rotatable in the above mentioned hole and slot, respectively, whereby the angular position of each of the diffuser vanes with respect to the center axis of the impeller and the distance between the outer peripheral end of the impeller and each of the guide vanes can be varied by turning at least one of two pins with respect to the support plates.

DETAILED DESCRIPTION OF THE PRIOR ART

Figure 1:
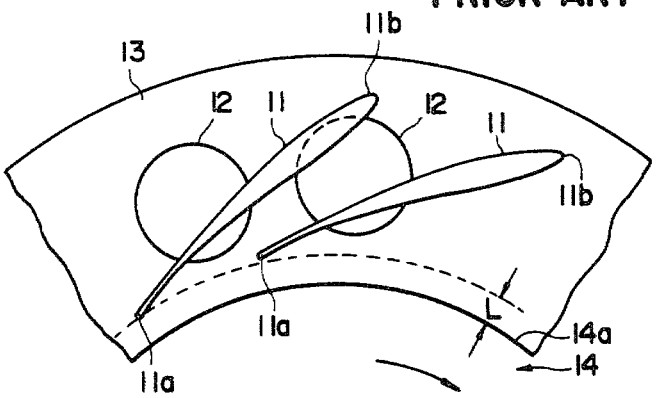
FIG. 1 PRIOR ART
FIG. 1 is a fragmentary axial end view schematically showing part of a variable-angle fluid diffuser of a prior-art centrifugal fluid compressor.

Referring to FIG. 1 of the drawings, a fluid diffuser of a known centrifugal fluid compressor comprises a plurality of variable-angle diffuser vanes 11 which are respectively secured to or integral with circular seat discs 12. Each seat disc 12 has a coaxial shaft (not shown) projecting from its end face opposite to the diffuser vane 11 and rotatably supported by a stationary support plate 13. The shaft has a threaded or serrated portion in mesh with a gear to be driven by a driving link element so that each of the seat discs 12 can be driven for rotation about the axis of the shaft. By rotation of each of the seat discs 12, the diffuser vane 11 supported thereon can be adjusted for any desired angular position with respect to the center axis of a fluid impeller 14 around which the seat discs 12 are circumferentially arranged. In this instance, the individual diffuser vanes 11 are arranged in such a manner as to assume identical angular positions with each other with respect to the center axis of the impeller 14. During operation of the fluid compressor including the impeller and diffuser arrangement of this nature, the fluid leaving the impeller 14 enters the gaps between the diffuser vanes 11 past respective leading edge portions 11*a* of the vanes and is discharged as compressed fluid out of the diffuser past respective trailing edge portions 11*b* of the vanes.

In order to reduce the fluid friction loss in the fluid compressor having the impeller and diffuser arrangement of the above described nature, it has been proposed to reduce the distance L between the outer peripheral end 14*a* and the leading edge portion 11*a* of each of the diffuser vanes. In the arrangement shown in FIG. 1, the distance L decreases when the driving link element associated with each of the seat discs 12 is operated to turn the seat disc in a counter-clockwise direction in FIG. 1 about the center axis of the disc.

Such an arrangement is, however, principally adapted to permit the individual diffuser vanes 11 to turn about the center axes of the seat discs 12 and is inherently not intended to achieve the purpose of reducing the distance L. Because, moreover, of the fact that it is objectionable to turn the diffuser vanes 11 beyond predetermined angles to the radical directions of the diffuser, the distance L can not be reduced to a satisfactory degree.

The arrangement shown in FIG. 1 is thus useful simply for achieving the purpose of reducing the fluid friction loss in the fluid compressor at low to high revolution speeds. The fluid friction loss in the compressor can be reduced effectively especially when the compressor is operating at high speeds so that the Mach number of the flow of the fluid directed from the impeller 14 toward the diffuser approximates the value 1. Problems are, however, encountered in that the fluid compressor operating under such conditions tends to produce more noise and in that shock waves are produced between the outer peripheral end 14*a* of the impeller 14 and the leading edge portions 11*a* of the diffuser vanes 11 and cause deterioration in the output performance of the compressor. Since, furthermore, the diffuser vanes 11 are turned about the respective center axes of the seat discs 12, the diffuser vanes 11 are caused to assume angular positions close to the radial directions of the diffuser when the diffuser vanes 11 are turned to reduce the distance L. When the diffuser vanes 11 are held in such angular positions, the fluid compressor tends to surge under low flow rate conditions.

In order to avoid surging at low flow rates, it is advantageous to have the diffuser vanes 11 turned to lie closer to the circumferential direction of the diffuser. This, however, results in a decrease in the distance L between the outer peripheral end 14*a* and the leading edge portions 11*a* of the diffuser vanes 11 and gives rise to an increase in the fluid friction loss in the compressor.

Thus, the impeller and diffuser arrangement of a prior-art centrifugal fluid compressor has not been fully acceptable for the purpose of achieving a satisfactory output performance because of the fact that each of the variable-angle diffuser vanes incorporated therein is designed to be rotatable about a single given axis and, therefore, can not be turned about such an axis without a change in the distance L between the outer peripheral end of the impeller and the leading edge portions of the diffuser vanes.

An object of the present invention is to provide a centrifugal fluid compressor featuring an improved impeller and diffuser arrangement in which each of the variable-angle diffuser vanes is rotatable about two axes one of which is fixed in the vane and the other of which is movable in a longitudinal direction of the vane.

DESCRIPTION OF THE PREFERRED EMBODIMENT

In FIGS. 2 to 5 of the drawings, the members and units similar to those forming part of the impeller and diffuser arrangement shown in FIG. 1 are designated by like reference numerals and characters.

Figure 2:
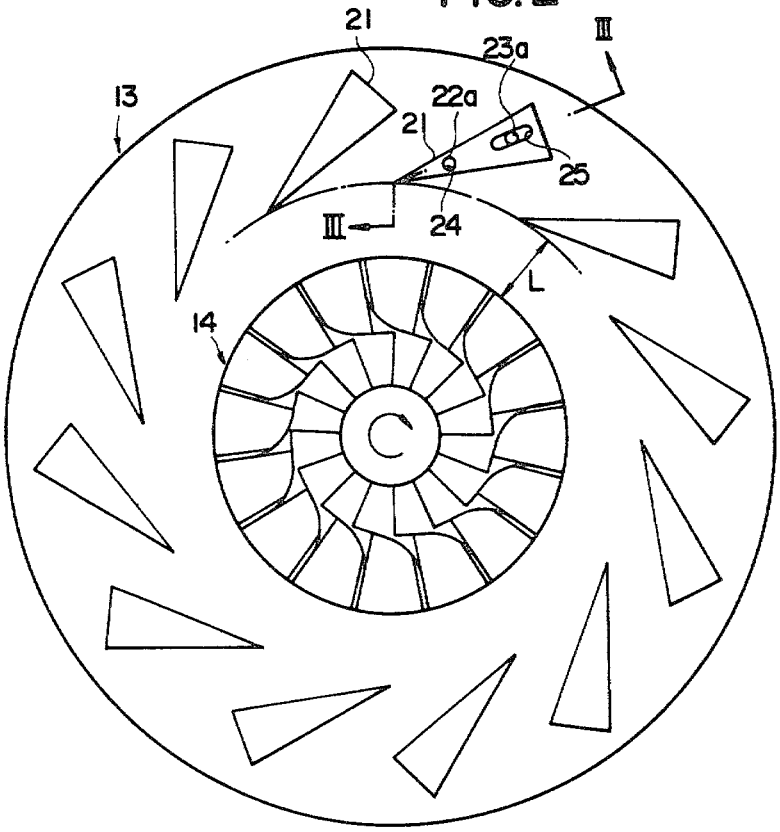
FIG. 2 is an axial end view schematically showing a fluid impeller and diffuser arrangement of a centrifugal fluid compressor embodying the present invention.
Figure 3:
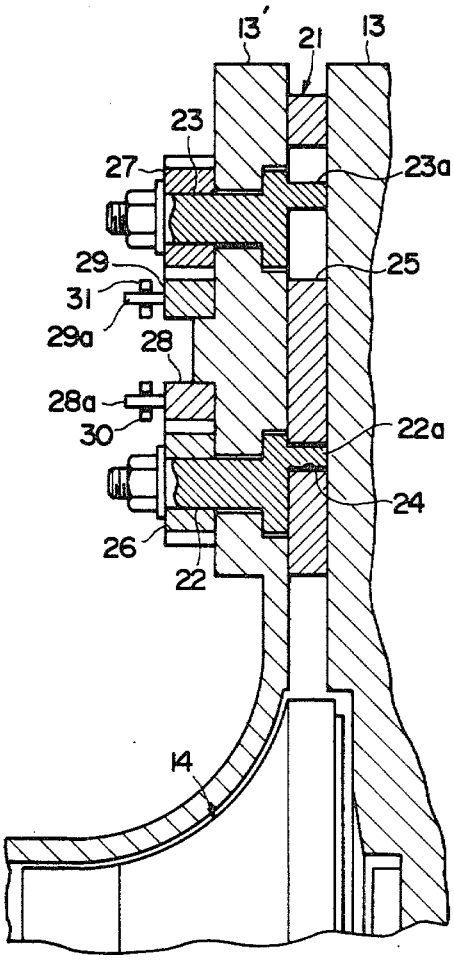
FIG. 3 is a cross sectional view taken on line III—III of FIG. 2 and showing, on an enlarged scale, the fluid impeller and diffuser arrangement illustrated in FIG. 2.

Referring to FIGS. 2 and 3, the fluid diffuser included in the centrifugal fluid compressor embodying the present invention comprises a plurality of variable-angle diffuser vanes 21 which are arranged circumferentially around a fluid impeller 14 rotatable about its center axis. The diffuser vanes 21 are movably interposed between two stationary support plates 13 and 13' which are spaced apart from each other in an axial direction of the diffuser. In association with each of the diffuser vanes 21 is provided a pair of eccentric members 22 and 23 which are rotatable independently of each other in openings formed in the support plate 13' and which have center axes substantially parallel with the center axis of the impeller 14. Eccentric pins 22*a* and 23*a* axially project form these eccentric members 22 and 23, respectively, and have center axes offset from the center axes of the eccentric members 22 and 23, respectively. Each of the diffuser vanes 21 is formed with a circular hole 24 and an elongated slot 25 which are spaced apart from each other longitudinally of the vane 21, the slot 25 being elongated also in a longitudinal direction of the vane 21. The above mentioned eccentric pins 22*a* and 23*a* axially project into these hole 24 and slot 25, respectively. The individual diffuser vanes 21 are spaced apart from each other in a circumferential direction of the diffuser as will be seen from FIG. 2 and form therebetween gaps for passing therethrough the fluid leaving the impeller 14.

As shown in FIG. 3, the eccentric members 22 and 23 are connected to pinions 26 and 27, respectively. The pinions 26 and 27 in turn are held in mesh with gears 28 and 29, respectively. The gear 28 has a shaft 28*a* projecting from one end face of the gear 28 and, likewise, the gear 29 has a shaft 29*a* projecting from one end face of the gear 29. The shafts 28*a* and 29*a* are coupled to driving link elements 30 and 31, respectively, which are operatively connected to suitable hydraulic actuators (not shown). When these hydraulic actuators are put into operation, the link elements 30 and 31 are actuated to drive the gears 28 and 29 for rotation about their respective center axes. The rotation of the gears 28 and 29 is transmitted through the pinions 26 and 27 to the eccentric members 22 and 23, respectively. Each of the eccentric pins 22*a* and 23*a* is accordingly driven to turn about the center axis of each of the eccentric members 22 and 23 and causes each of the diffuser vanes 21 to change its angular position with respect to the center axis of the impeller 14.

In the embodiment illustrated in the drawings, the hydraulic actuators for the driving link elements 30 and 31 are assumed to be operated in accordance with signals dependent on operating conditions of a gas turbine engine so that the variable-angle diffuser vanes 21 are adjusted for proper angular positions which vary with the operating conditions of the engine.

Figure 4:
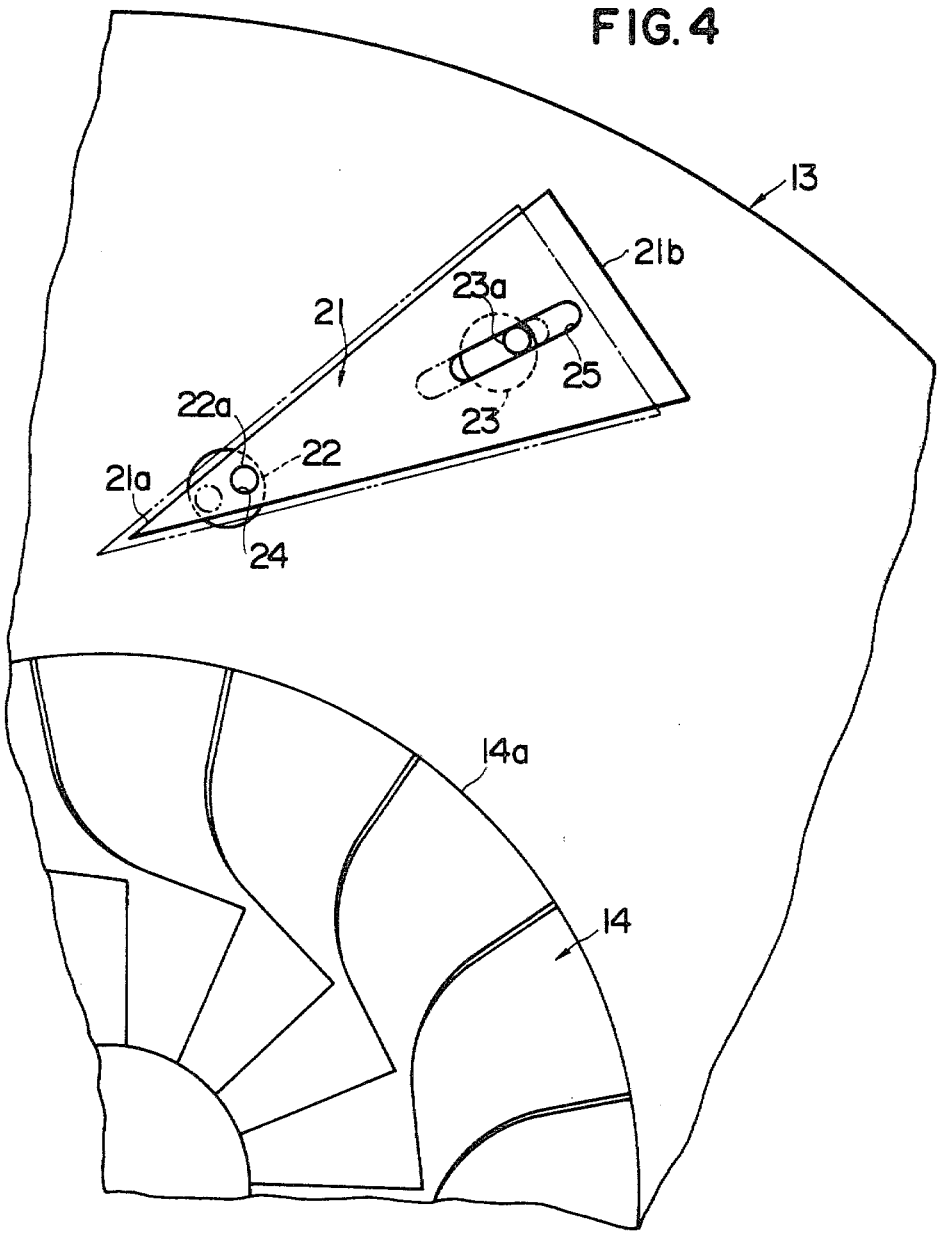
FIGS. 4 and 5 are fragmentary axial end views showing, on enlarged scales, different operational conditions of the variable-angle diffuser vanes in the fluid impeller and diffuser arrangement illustrated in FIGS. 2 and 3.
Figure 5:
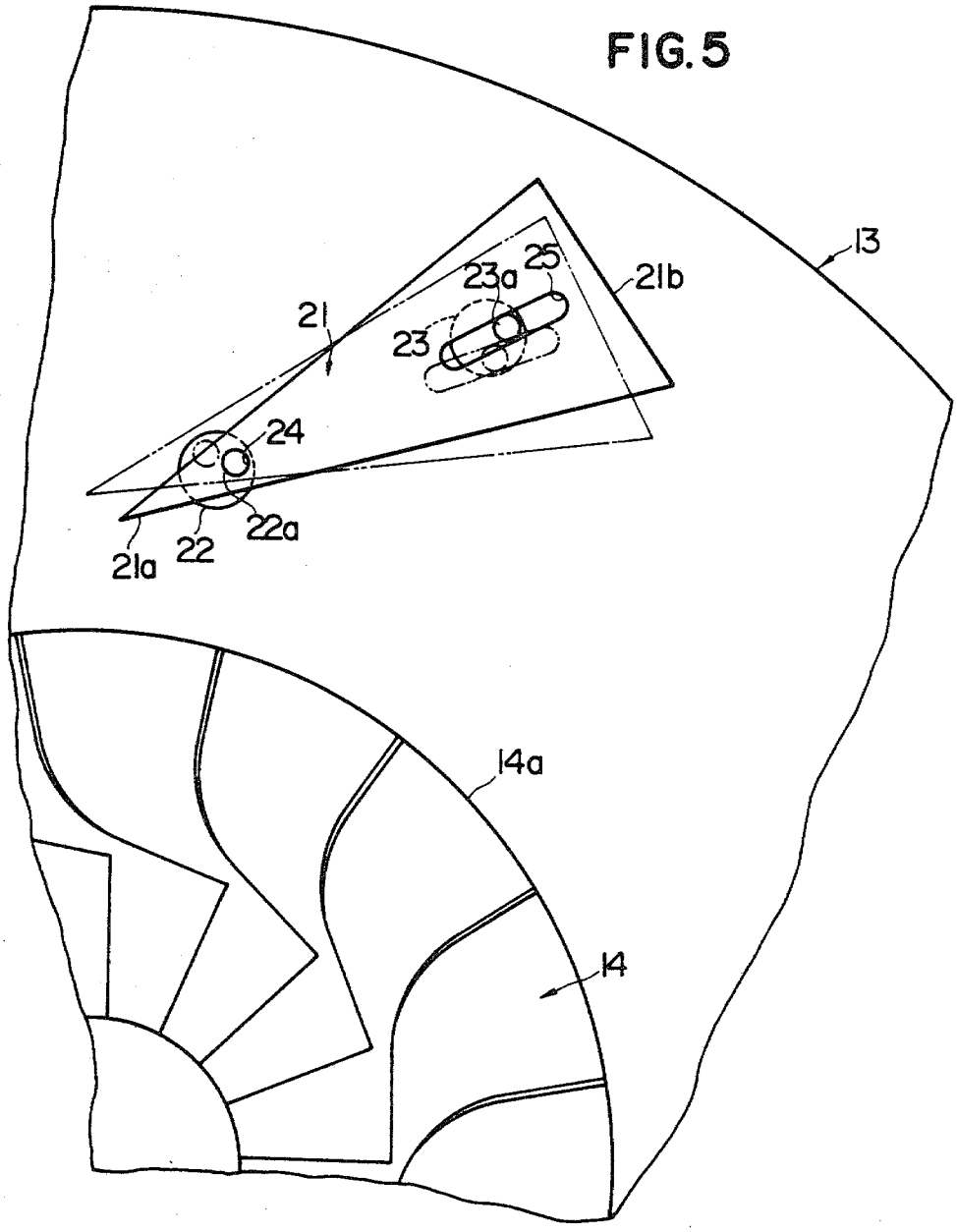

Under rated operating conditions of the engine, each of the variable-angle diffuser vanes 21 is turned into an angular position indicated by full lines in FIG. 4. When each of the diffuser vanes 21 is held in this angular position, the eccentric pins 22*a* and 23*a* associated with each diffuser vane 21 are located closer to the trailing edge portion 21*b* of the vane 21 than the center axes of the eccentric members 22 and 23, respectively.

During low-speed operating conditions such as idling of the engine, the eccentric members 22 and 23 are turned so that the eccentric pins 22*a* and 23*a* are located closer to the leading edge portion 21*a* of the diffuser vane 21 than the center axes of the eccentric members 22 and 23, respectively. In this instance, each of the diffuser vanes 21 is held in an angular position indicated by dot-and-dash lines in FIG. 4. Under low-load or low-speed conditions of the engine, each of the diffuser vanes 21 is thus held in an angular position substantially identical with the angular position of the vane 21 under rated operating conditions of the engine but is moved closer to the outer peripheral end 14*a* of the impeller 14 so that the distance L between the end 14*a* and the leading edge portion 21*a* of each vane 21 is reduced as compared with the distance L under the rated operating conditions of the engine. The distance L can thus be reduced without causing the diffuser vanes 21 to turn closer to the radial directions of the diffuser. The fluid friction loss resulting from the friction imparted to the fluid flowing on the wall surfaces of the support plates 13 and 13' can thus be lessened without giving a rise to an increase in the critical limit beyond which surging is to occur.

When the engine is accelerated from idling conditions, the radially inner eccentric member 22 is to be driven to turn in a clockwise direction and the radially outer eccentric member 23 is to be driven to turn in a counter-clockwise direction in FIG. 4. When the eccentric members 22 and 23 are turned in these directions, the diffuser vane 21 associated therewith is moved into an angular position indicated by full lines in FIG. 5 if the engine is operating under rated conditions. During movement of the diffuser vane 21 into such an angular position, the vane temporarily assumes a transient angular position indicated by dot-and-dash lines in FIG. 5. The transient angular position of the diffuser vane 21 thus lying closer to the circumferential direction of the diffuser corresponds to accelerating conditions of the engine. When the diffuser vanes 21 lie closer to the circumferential direction of the diffuser, surging takes place at reduced flow rates in the compressor. For this reason, the engine is enabled to accelerate at increased rates from idling conditions since the compressor becomes less liable to cause surging in spite of the fact that the flow rate of the fluid flowing through the compressor per revolution of the compressor rotor becomes lower than under constant-speed operating conditions of the engine.

As will have been appreciated from the foregoing description, the impeller and diffuser arrangement proposed by the present invention is characterized in that each of the variable-angle diffuser vanes is moved by means of two eccentric pins which are rotatable independently of each other about the axes respectively offset from the center axes of the pins per se. By virtue of such an arrangement, the angular position of each diffuser vane and the distance between the leading end of the vane and the outer peripheral end of the impeller can thus be determined independently of each other depending upon the operating conditions of, for example, a gas turbine engine. The angular and radial position of each diffuser vane with respect to the center axis of the impeller can therefore be determined in such a manner as to satisfactorily meet the requirements of the centrifugal compressor depending upon the various operating conditions of the engine.

When the operating conditions of the engine are changed from rated conditions to low-load or low-speed conditions, the diffuser vanes are moved in such a manner as to reduce the distance between the outer peripheral end of the impeller and each of the leading edge portions of the vanes so as to reduce the fluid friction loss in the compressor. The angular positions of the diffuser vanes thus moved are however kept unchanged with respect to the center axis of the impeller. The critical limit of the flow rate to cause surging is therefore not increased as a result of the angular movement of the diffuser vanes so that the centrifugal compressor is permitted to exploit its inherent functions.

When, on the other hand, the engine is accelerated from idling conditions, the diffuser vanes temporarily assume transient angular positions closer to the circumferential direction of the diffuser before the vanes are turned into the angular positions predetermined for rated operating conditions of the engine. The critical limit of the fluid flow rate to cause surging is therefore reduced during acceleration of the engine so that the engine is permitted to accelerate at increased rates.

It may also be added that a centrifugal compressor according to the present invention can be adjusted for standardized performance characteristics by adjusting the angular positions of the eccentric pins with respect to the associated diffuser vanes. This will contribute to regularization of the performance quality of the centrifugal compressors manufactured on a large-scale commercial basis.

Although particular embodiments of the present invention have been shown and described, it will be obvious to those skilled in the art that various changes and modifications may be made without departing from the spirit and scope of the present invention.

What is claimed is:

1. A centrifugal fluid compressor including a fluid impeller rotatable about its center axis and a fluid diffuser comprising a plurality of diffuser vanes positioned around said impeller, each of said diffuser vanes being formed with a circular hole and an elongated slot which are spaced apart from each other longitudinally of said diffuser vane, said elongated slot extending in the longitudinal direction of said diffuser vane, said diffuser further comprising two stationary support plates which are spaced apart from each other in an axial direction of said diffuser and which have said diffuser vanes movably interposed therebetween, and two eccentric pins provided in association with each of said diffuser vanes, said pins being supported on one of said support plates respectively through openings formed therein and being rotatable independently of each other about axes of rotation offset from respective center axes of said eccentric pins which are substantially parallel with the center axis of said impeller, said pins axially projecting into and being rotatable in said hole and said slot, respectively, whereby said angular position and said distance can be varied by turning at least one of said pins with respect to said support plates.

2. A centrifugal fluid compressor including a fluid impeller rotatable about its center axis and a fluid diffuser comprising a plurality of diffuser vanes positioned around said impeller, and means for varying the angular position of each of said vanes with respect to the center axis of said impeller and for varying the distance between the outer peripheral end of said impeller and each of said diffuser vanes in a radial direction of said diffuser independently of each other.

* * * * *